US012018504B2

(12) United States Patent
Tessier

(10) Patent No.: US 12,018,504 B2
(45) Date of Patent: Jun. 25, 2024

(54) SHELTER

(71) Applicant: Emmanuelle Tessier, Town of Mount-Royal (CA)

(72) Inventor: Emmanuelle Tessier, Town of Mount-Royal (CA)

( * ) Notice: Subject to any disclaimer, the term of this patent is extended or adjusted under 35 U.S.C. 154(b) by 429 days.

(21) Appl. No.: 17/479,678

(22) Filed: Sep. 20, 2021

(65) Prior Publication Data

US 2022/0090408 A1 Mar. 24, 2022

Related U.S. Application Data

(60) Provisional application No. 63/081,031, filed on Sep. 21, 2020.

(51) Int. Cl.

| | |
|---|---|
| ***E04H 15/54*** | (2006.01) |
| ***A47C 29/00*** | (2006.01) |
| ***E04H 15/00*** | (2006.01) |
| ***E04H 15/02*** | (2006.01) |
| ***E04H 15/32*** | (2006.01) |
| ***E04H 15/38*** | (2006.01) |
| ***E04H 15/58*** | (2006.01) |

(52) U.S. Cl.

CPC ..... *E04H 15/54* (2013.01); *A47C 29/003* (2013.01); *E04H 15/008* (2013.01); *E04H 15/02* (2013.01); *E04H 15/324* (2013.01); *E04H 15/38* (2013.01); *E04H 15/58* (2013.01)

(58) Field of Classification Search

CPC ..... A47C 29/003

See application file for complete search history.

(56) References Cited

U.S. PATENT DOCUMENTS

| | | | | | |
|---|---|---|---|---|---|
| 1,594,256 | A | * | 7/1926 | Greene | A47C 29/006 D6/382 |
| 2,035,343 | A | * | 3/1936 | Riley | A47C 21/08 454/197 |
| 2,036,033 | A | | 3/1936 | Tompkins | |
| 3,536,083 | A | * | 10/1970 | Reynolds | E04H 15/324 135/132 |
| 4,109,331 | A | * | 8/1978 | Champeau | A47C 21/00 5/904 |
| 4,131,312 | A | | 12/1978 | Price | |
| 4,229,845 | A | | 10/1980 | Cuadros | |

(Continued)

FOREIGN PATENT DOCUMENTS

| | | |
|---|---|---|
| CN | 201958233 | 9/2011 |
| CN | 202312220 | 7/2012 |

(Continued)

*Primary Examiner* — David R Dunn
*Assistant Examiner* — Danielle Jackson

(57) ABSTRACT

A shelter including a supporting component having a main supporting surface configured and sized for supporting a human in a sleeping position, the supporting component defining substantially opposed supporting component first and second longitudinal ends; a first end wall and a second end wall provided respectively at the supporting component first and second longitudinal ends; and a roof movable between a closed configuration and an open configuration, wherein, in the closed configuration, the roof is overlying the main supporting surface, and in the open configuration, the roof is at least partially retracted from the main supporting surface to allow outside access thereto.

30 Claims, 9 Drawing Sheets

(56) References Cited

U.S. PATENT DOCUMENTS

| | | | | | |
|---|---|---|---|---|---|
| 4,550,457 | A | * | 11/1985 | Dukkers | A47C 21/00 5/633 |
| 4,716,919 | A | * | 1/1988 | Griffin | E04H 15/48 135/901 |
| 5,240,021 | A | * | 8/1993 | Snodgrass | E04H 15/425 5/127 |
| 5,343,887 | A | | 9/1994 | Danaher | |
| D378,171 | S | | 2/1997 | Liu | |
| 5,609,391 | A | | 3/1997 | Watts et al. | |
| 5,740,828 | A | * | 4/1998 | Evans | E04H 6/04 135/132 |
| D439,422 | S | | 3/2001 | Hecht et al. | |
| 7,150,052 | B1 | * | 12/2006 | Lawson | A47D 9/00 5/97 |
| 9,782,010 | B1 | * | 10/2017 | Bodden-Burdick | A47C 7/666 |
| 10,415,265 | B1 | | 9/2019 | Liang | |
| 10,548,413 | B2 | * | 2/2020 | Smith | A47D 15/008 |
| 10,570,638 | B2 | | 2/2020 | Clark et al. | |
| 10,985,689 | B2 | | 4/2021 | Wickramasekera | |
| 11,015,363 | B2 | * | 5/2021 | Clark | E04H 15/48 |

FOREIGN PATENT DOCUMENTS

| | | | | | |
|---|---|---|---|---|---|
| CN | 202891242 | | | 4/2013 | |
| CN | 203416985 | | | 2/2014 | |
| CN | 205053427 | | | 3/2016 | |
| CN | 106983303 | | | 7/2017 | |
| DE | 2250512 | | | 5/1974 | |
| DE | 4207030 | | | 9/1993 | |
| DE | 19512872 | | | 10/1996 | |
| DE | 10317630 | | | 10/2004 | |
| DE | 202008013582 | | | 2/2009 | |
| DE | 202010004403 | | | 8/2010 | |
| DE | 202010005774 | | | 9/2010 | |
| EP | 1358823 | | | 11/2003 | |
| ES | 1077087 | | | 6/2012 | |
| FR | 2601304 | | | 1/1988 | |
| FR | 2686639 | | | 7/1993 | |
| FR | 2818882 | | | 7/2002 | |
| GB | 486110 | | | 5/1938 | |
| GB | 955207 | | | 4/1964 | |
| GB | 2504146 | | | 1/2014 | |
| GB | 2570204 | | | 7/2019 | |
| JP | 06200642 | A | * | 7/1994 | |
| JP | 2006254968 | A | * | 9/2006 | A47C 29/003 |
| JP | 2007097901 | A | * | 4/2007 | A47C 29/003 |
| KR | 20180001683 | U | * | 6/2018 | |
| KR | 102237708 | B1 | * | 4/2021 | |
| WO | 2007113869 | | | 10/2007 | |

* cited by examiner

SHELTER

FIELD OF THE INVENTION

The present invention relates to the general field of shelters and is particularly concerned with a shelter for sheltering the homeless or other people in need of a temporary shelter.

BACKGROUND

There exists a plurality of situations leading to a need for a temporary shelter or bivouac accommodation. For example, travelers sometimes have to stay in an airport overnight for various reasons including the timing of connecting flights, missed fights or the like.

Other examples of situations wherein a temporary shelter is needed includes overnight stay in the hospital room of an hospitalized relative or overnight stay in any other type of public or private area. Shelters are also extensively used by outdoor activity of all sorts including mountain climbers, hunters, wilderness adventurers and the like. Shelters are further useful in other settings such as for rescue deployment or for the military.

Shelters could also be useful at music festivals or adjacent bars where they could avow potential users to sleep over. This could prove to be particularly useful for allowing potential drivers under the influence of alcohol or another substance to sleep and recuperate instead of taking the road.

Shelters could further be useful in various other situations. For example, shelters could be provided for employees allowing them to take restful naps during work breaks and for students during class breaks or recess in both cases potentially improving efficiency. Also, shelters could be used as cost saving alternative to youth hostels or the like.

Shelters are particularly useful for homeless people who have permanently or temporarily no fixed accommodation for various reasons. These include people, who can no longer live in permanent accommodation because of a damaging event, such as earthquakes, fire, flood or storm or refugees.

The need for temporary shelters is particularly acute for homeless people living in urban areas having loss their access to a permanent accommodation because of financial hardship, mental heath issues or the like. Once an individual has been homeless for any period of time it is often difficult to get off the streets and back into regular job to earn sufficient income for housing, especially where rents are high.

This type of homeless people either spends the night out in the open in self-constructed, makeshift dwellings or in overnight shelters for the homeless. Local governments and certain private charitable groups indeed provide certain community shelters in large buildings for the homeless, but the number of spaces available falls far short of the needs of the homeless.

It is particularly the case in harsh winters that such overnight shelters are however fully occupied, so that with freezing temperatures many homeless people must spend the night in theft makeshift dwellings or at locations out in the open which provide a little shelter. These opportunities for spending the night however provide much too little protection from the weather conditions and in particular low temperatures, so that it is indeed in harsh winters that death and freezing often occurs amongst the homeless Emergency and transitional shelters such as missions do not follow the same procedures when it comes to access.

Some are first come-first serve, where the individual leaves for the day to return to claim a bed, while others offer a bed for a specified period of time. Even greater restrictive access occurs at shelters that provide housing only during extreme cold Moreover, crowding the homeless into community shelters creates an unpleasant environment, as they lack privacy or separation from others, such that there are noise, health and security problems, especially in times of pandemic viruses. For example, people experiencing homelessness are at risk for infection during community spread of COVID-19 or other disease. Transmission of virus or other pathogens could cause illness among people already confronted with the hardships associated with experiencing homelessness, contribute to an increase in emergency shelter usage, and/or lead to illness and absenteeism among homeless service provider staff.

To further compound the problem, even though the majority of individuals who are homeless seek help, many choose to live on the streets due to perceived absence of dignity experienced at some shelters.

The homeless population of urban areas is typically concentrated near downtown which is generally vacated by working people at night or around subway stations.

Although the prior art reveals some examples or temporary or bivouac shelters non are particularly well adapted for use in the hereinabove mentioned settings, in particular for use by the homeless population in urban areas. Accordingly, there exists a need for an improved shelter. It is an object of the invention to provide such a shelter.

SUMMARY OF THE INVENTION

In accordance with an embodiment of the invention, there is provided a shelter adapted to be used for supporting and sheltering a human, the shelter comprising a supporting component having a main supporting surface configured and sized for supporting the human in a sleeping position; a first end wall and a second end wall attached to the supporting component for maintaining the supporting component in a spaced apart relationship relative to the ground; and at least one protective panel slidably mounted to the first and second end walls for slidable movement between a closed panel position wherein the at least one protective panel is in at least partially overlying relationship relative to at least a portion of the supporting component and an open panel position wherein the at least one protective panel is at least partially retracted from at least a portion of the supporting component.

In a broad aspect, there is provided a shelter comprising: a supporting component having a main supporting surface configured and sized for supporting a human in a sleeping position, the supporting component defining substantially opposed supporting component first and second longitudinal ends; a first end wall and a second end wall provided respectively at the supporting component first and second longitudinal ends; and a roof movable between a closed configuration and an open configuration, wherein, in the closed configuration, the roof is overlying the main supporting surface, and in the open configuration, the roof is at least partially retracted from the main supporting surface to allow outside access thereto.

There may also be provided a shelter wherein, in the closed configuration, the roof, supporting component, first end wall and second end wall together delimit an enclosure for sheltering the human in the sleeping position on the main supporting surface.

There may also be provided a shelter wherein in the open configuration, the roof is substantially entirely located below the main supporting surface.

There may also be provided a shelter wherein the supporting component is attached to both the first and second end walls so that when the first and second end walls are supported on a ground surface, the supporting component is supported in a spaced apart relationship relative to the ground surface by the first and second end walls.

There may also be provided a shelter wherein the roof includes at least one protective panel of generally arcuate configuration mounted to first and second guides of arcuate configuration provided at the first and second end walls so that the at least one protective panel is movable along the first and second guides, the at least one panel being movable between closed and open panel positions, wherein in the closed panel position, the roof is in the closed configuration and the at least one protective panel is in an at least partially overlying relationship relative to at least a portion of the supporting component, and in the open panel position, the roof is in the open configuration and the at least one protective panel is at least partially retracted from the at least a portion of the supporting component.

There may also be provided a shelter wherein the first and second guides each include at least one arcuate groove spanning a larger angle than the at least one panel and to which the at least one protective panel is mounted so as to be movable therealong.

There may also be provided a shelter wherein the at least one protective panel includes first and second panels each of generally arcuate configuration, the second panel having a second panel radius of curvature smaller than a first panel radius of curvature of the first protective panel.

There may also be provided a shelter wherein the first and second arcuate guides each include a pair of grooves, the grooves within each of the pair of grooves having different groove radii of curvature, the first and second protective panels being each mounted to a respective one of the grooves from the pair of grooves in both the first and second guides so that the first and second protective panels are movable along the grooves.

There may also be provided a shelter wherein the first protective panel includes a first coupler and the second protective panel includes a second coupler, the first and second couplers being configured and sized to mechanically interfere with each other when the at least two panels are in a predetermined positional relationship relative to each other to allow dragging the second protective panel along the first and second guides by the first protective panel when the first protective panel is moved along the first and second guides by an intended user.

There may also be provided a shelter wherein in the predetermined configuration the first and second protective panels are in substantially register with each other.

There may also be provided a shelter wherein in the open configuration, the first and second protective panels are in the predetermined configuration.

There may also be provided a shelter wherein in the predetermined configuration, the first and second protective panels are offset from each other so that only a portion thereof overlap.

There may also be provided a shelter wherein in the closed configuration, the first and second protective panels are in the predetermined configuration.

There may also be provided a shelter further comprising a seal between the first and second couplers.

There may also be provided a shelter wherein the first and second protective panels each span between about 85 and 95 degrees.

There may also be provided a shelter wherein the roof is substantially hemicylindrical.

There may also be provided a shelter wherein the first and second guides each define a deployed section and a stowage section, the first and second protective panels being in the deployed section in the closed configuration and the first and second protective panels being in the stowage section in the open configuration.

There may also be provided a shelter wherein in the open configuration, the first and second protective panels are substantially in register with each other in a stowage section.

There may also be provided a shelter wherein the stowage section is located below the supporting component.

There may also be provided a shelter wherein the shelter further defines an enclosed storage space below the supporting component accessible through a selectively openable door.

There may also be provided a shelter wherein the door extends between the first and second end walls and is mounted thereto.

There may also be provided a shelter further comprising a lock for locking the roof in the closed configuration.

There may also be provided a shelter wherein the lock is operable from inside the roof to selectively lock and unlock the roof to respectively prevent and allow movements thereof from the closed configuration to the open configuration.

There may also be provided a shelter wherein the lock is also operable from outside the roof.

There may also be provided a shelter wherein the supporting component includes supporting component first and second sections hinged to each other and movable between a bed configuration in which the supporting component first and second sections are substantially co-planar, and a bench configuration wherein the supporting component first section is substantially horizontal and the supporting component second section extends away from the supporting component first section at an upward angle relative thereto.

There may also be provided a shelter further comprising a cushioning component by the supporting component.

There may also be provided a shelter further comprising a mosquito screen movable between mosquito screen deployed and retracted configurations, wherein, in the mosquito screen deployed configuration, the mosquito screen, supporting component, first end wall and second end wall form an enclosure from which mosquitoes are substantially prevented from entering, and in the mosquito screen retracted configuration, the mosquito screen is at least in part retracted from the supporting component to allow access to the main support surface.

Various embodiments of the proposed shelter may provide one or more of the following advantages. The proposed shelter may be relatively simple with regards to design and assembly, as well as relatively inexpensively manufacturable. Also, the shelter may specifically adapted for the homeless population. The shelter may offer an individualized environment. The shelter may be water-tight to protect users from the elements, while remaining relatively easily cleaned or hosed out after each use. The shelter may be manufactured as relatively lightweight and portable for easy transportation to a preferred site and may be easily grouped together with similar shelters or stacked for storage.

The shelter may be manufactured out of fire-resistant materials and/or sound dampening materials. In some embodiments, the shelter may have smooth corners and edges to avoid injuring users.

The shelter may be suitable for sleeping, as a provisional accommodation with privacy, as well as for the storage and for the protection of personal belongings. The shelter may have a sleeping compartment separate from a storage compartment, and the shelter may allow separate access to the bed and storage compartments. Also, the shelter may have separately lockable bed and storage sections.

In some embodiments, the shelter may be usable also as a bench, and may be easily and readily converted between bench and bed configurations.

The shelter may be provided with adequate ventilation to maintain proper environmental conditions thereinto.

The shelter may be designed improve the efficiency and quality of life of its student and worker potential users. Also, one may provide a set of shelters that can be used by the homeless in other to provided a gathering area for them, potentially improving their access to quality care. For example, and non-limitingly, the shelter may be located in an underground network of passageways of an urban area.

BRIEF DESCRIPTION OF THE DRAWINGS

Embodiments of the present invention will now be described, by way of example, in reference to the following drawings in which.

DETAILED DESCRIPTION

Figure 9:
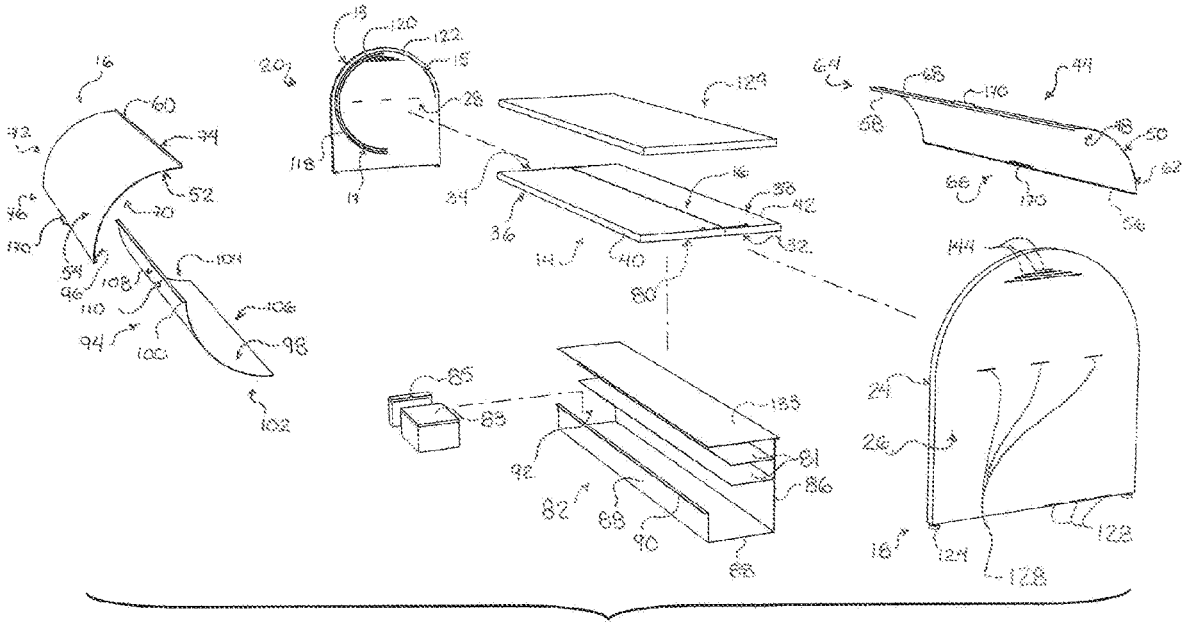
FIG. 9: in an exploded view illustrates the shelter of FIG. 1.
Figure 26:
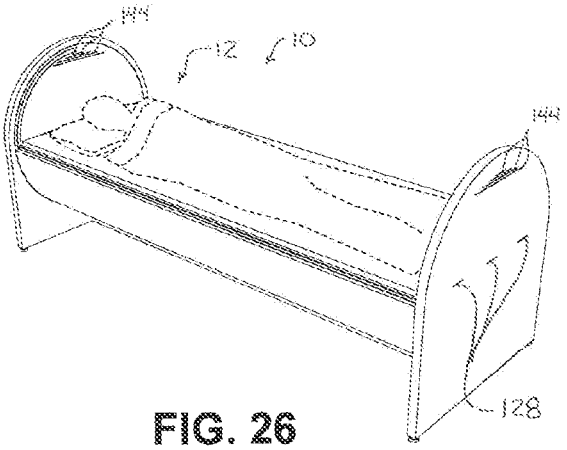
FIG. 26: in a perspective view illustrates the shelter of FIG. 1 in a bed configuration.

Referring to FIG. 26, there is shown a shelter generally indicated by the numeral 10 adapted to be used for supporting and sheltering a human, shown in phantom lines and generally indicated the numeral 12. The shelter 10 includes a supporting component 14. As illustrated in FIG. 9, the supporting component 14 has a main supporting surface 16. The main supporting surface 16 is configured and sized for supporting the human 12 in a sleeping position.

Figure 27:
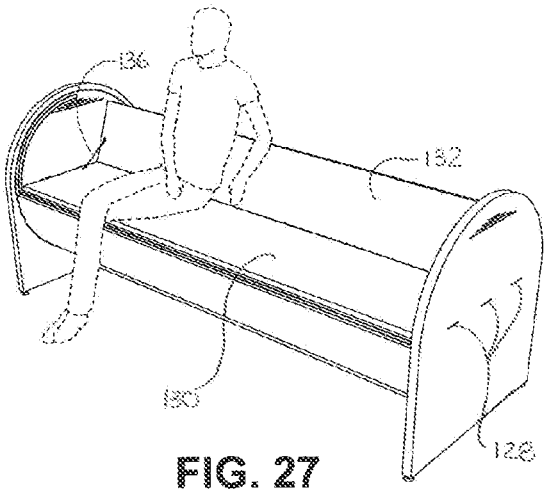
FIG. 27: in a perspective view illustrates the shelter of FIG. 1 in a bench configuration.

The shelter 10 also includes a first end wall 18 and a second end wall 20 attached to the supporting component 14 for maintaining the supporting component 14 in a spaced apart relationship relative to the ground 22. Similar shelters may however have other supports for supporting the supporting component 14 either alone or in combination with the first and second end walls 18 and 20. As shown in FIG. 27, the supporting component 14 is also in some embodiments configured, sized and spaced from the ground so as to also be usable as a bench for sitting thereon.

Figure 6:
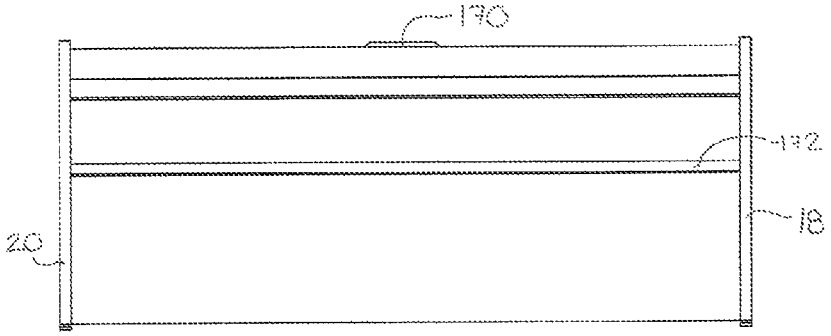
FIG. 6: in a rear view illustrates the shelter of FIG. 1 with its roof in the closed configuration.
Figure 7:
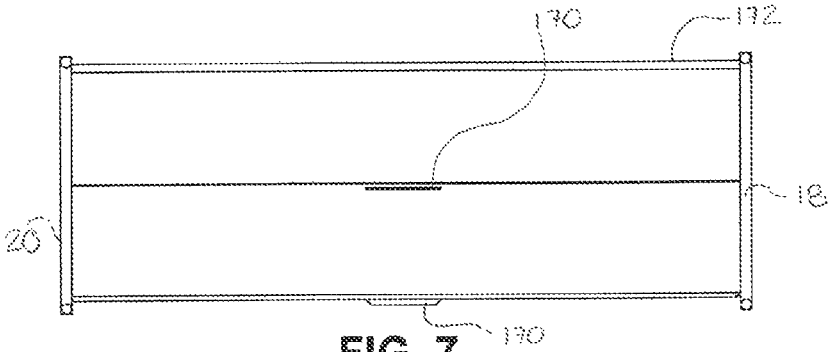
FIG. 7: in top side view illustrates the shelter of FIG. 1 with its roof in the closed configuration.
Figure 8:
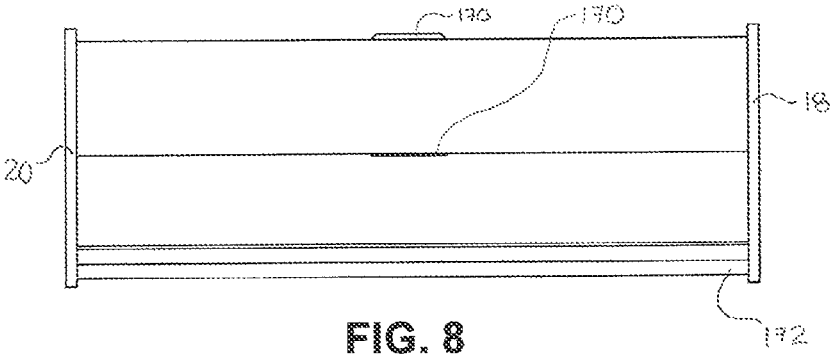
FIG. 8: in a bottom view illustrates the shelter of FIG. 1 with its roof in the closed configuration.

In one embodiment of the invention illustrated in FIGS. 6 through 8, the shelter 10 also includes at least one reinforcement component extending between the first and second end walls 18 and 20 for maintaining the latter in their parallel and spaced apart relationship relative to each other. The reinforcement component may take any suitable form such as that of a substantially elongated reinforcement bracket 172 or the like.

Figure 1:
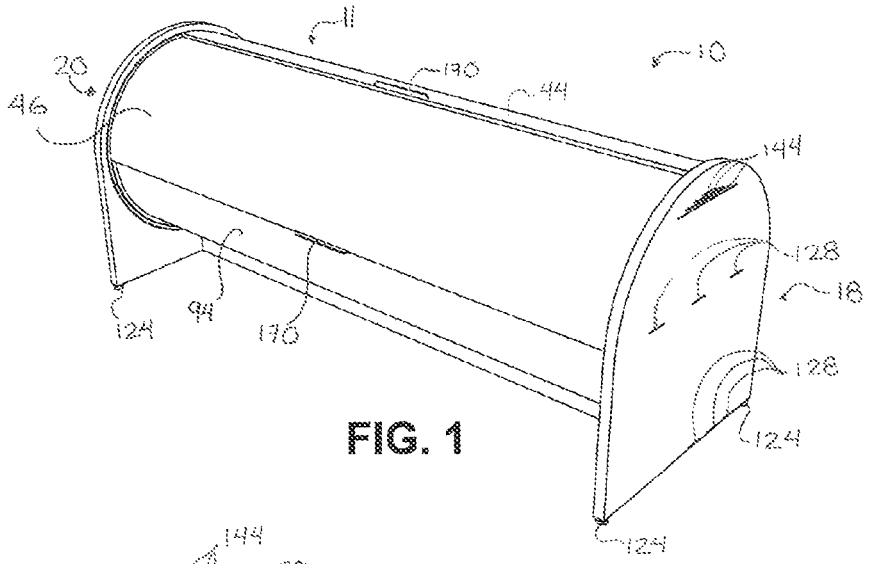
FIG. 1: in a perspective view illustrates a shelter in accordance with an embodiment of the present invention with its roof in a closed configuration.
Figure 2:
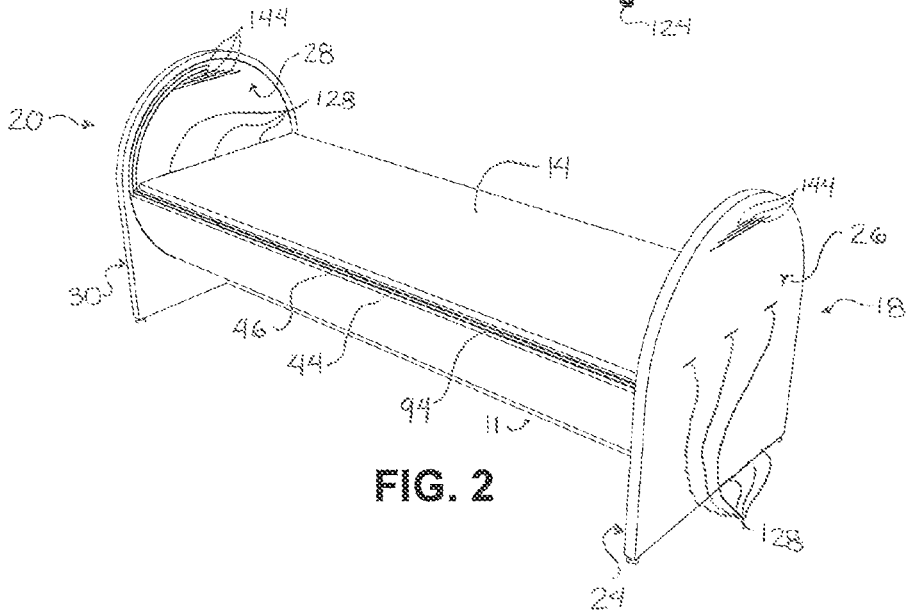
FIG. 2: in a perspective view illustrates the shelter of FIG. 1 in a bed configuration with with its roof in an open configuration.

The shelter 10 is also provided with a roof 11 movable between a closed configuration (seen in FIG. 1 for example) and an open configuration (seen in FIG. 2 for example). In the closed configuration, the roof 11 is overlying the main supporting surface 16, and in the open configuration, the roof 11 is at least partially retracted from the main supporting surface 16 to allow outside access thereto. In some embodiments, in the closed configuration, the roof 11, supporting component 14, first end wall 18 and second end wall 20 together delimit an enclosure for sheltering the human 12 in the sleeping position on the main supporting surface 16. This is for example seen in FIG. 10 in which the second end wall 20 has been removed to show the interior of the shelter 10 in the closed configuration. In some embodiments, as illustrated in FIG. 2 for example, in the open configuration, the roof 11 is substantially entirely located below the main supporting surface 16, therefore allowing full access thereto. Typically, small gaps between some components of the shelter 10 or dedicated vents may be provided to allow air circulation in the shelter 10, and these gaps and vents are typically designed so that precipitations cannot enter the shelter 10.

For example, the roof 11 includes at least one protective panel slidably mounted to the first and second end walls 18 and 20 for slidable movement between a closed panel position wherein the at least one protective panel is in at least partially overlying relationship relative to at least a portion of the supporting component 14 and an open panel position wherein the at least one protective panel is at least partially retracted from at least a portion of the supporting component 14. For example, the at least one protective panel is of generally arcuate configuration, in other words shaped generally like the curved surface of a cylindrical wedge.

The first and second end walls 18 and 20 are each provided with a respective guide 13 of arcuate configuration to which the at least one panel is mounted so that the at least one protective panel is movable along the guides. The at least one panel being movable between closed and open panel positions. In the closed panel position, the roof 11 is in the closed configuration and the at least one protective panel is in an at least partially overlying relationship relative to at least a portion of the supporting component 14. In the open panel position, the roof 11 is in the open configuration and the at least one protective panel is at least partially retracted from the at least a portion of the supporting component 14. The guides may be embodied by grooves in which the longitudinally opposed ends of the at least one panel is inserted, as described in further details below. However, in alternative embodiments, the guides may take any other form, such as rails along which rollers secured to the at least one panel may roll, among other possibilities.

Referring to FIG. 2, the first end wall 18 defines a first end wall inner surface 24 and a first end wall outer surface 26. Similarly, the second end wall 20 defines a second end wall inner surface 28 and a second end wall outer surface 30. In some embodiments, the at least one protective panel is slidably mounted to the first end wall inner surface 24 and the second end wall inner surface 28.

Typically, the supporting component 14 has a substantially elongated configuration defining a supporting component first longitudinal end 32 and a supporting component second longitudinal end 34. The supporting component first longitudinal end 32 is provided at and typically attached to the first end wall inner surface 24 and the supporting component second longitudinal end 34 is provided at and typically attached to the second end wall inner surface 28.

Referring to FIG. 9, the supporting component 14 also defines a supporting component first transversal end 36 and a substantially opposed supporting component second transversal end 38. The supporting component first transversal end 36 typically defines a supporting component first transversal surface 40. The supporting component second transversal end 38 typically defines a supporting component second transversal surface 42.

In the illustrated embodiment of the invention, the at least one protective panel is slidably mounted to the first and second end walls 18 and 20 so as to move between the open and closed panel positions in a substantially arcuate movement.

Also, as seen in FIG. 1, in the illustrated embodiment of the invention, the at least one protective panel includes a first protective panel 44 and a second protective panel 46. It should however be understood that any suitable number of protective panels could be used without departing from the spirit of the invention. In a specific embodiment of the invention, each of the first and second panels span about 90 degrees, for example between 85 and 95 degrees. Typically, the first and second panels will span a bit more than 90 degrees so as to together defines a complete half-cylinder and overlap slightly at their junction. This configuration provides good protection from precipitations falling from above.

Typically, each of the first and second protective panels 44 and 46 are slidably mounted to the first end wall inner surface 24 and the second end wall inner surface 28 for slidable movement in a substantially arcuate movement pattern between the closed panel position wherein the first or second protective panel 44 and 46 is in a substantially overlying relationship relative to at least a portion of the supporting component 14 and the open panel position wherein the first or second protective panels 44 and 46 is at least partially retracted from at least a portion of the supporting component 14.

Typically, when the first and second protective panels 44 and 46 are in the open panel position at least a portion of the first and second protective panels 44 and 46 are in a partially overlapping relationship relative to each other. For example, the first and second protective panels may be substantially completely in register with each other in the open panel position, with only a small portion thereof protruding from the superposed first and second protective panels 44 and 46 due to the presence of couplers allowing joint handling of the first and second protective panels 44 and 46 through only one of the first and second protective panel as further described hereinbelow.

In some embodiments, the guides 13 each define a deployed section 15 and a stowage section 17. The first and second protective panels 44 and 46 are in the deployed section 15 in the closed configuration and the first and second protective panels are in the stowage section in the open configuration. For example, in the open configuration, the first and second protective panels 44 and 46 are substantially in register with each other in a stowage section 17, which is typically located below the supporting component 14. If the first and second protective panels span from about 85 degrees to about 95 degrees, the stowage section may span from about 85 to 100 degrees, and the deployed section may span from about 170 to about 190 degrees, although other values are within the scope of the invention.

The shelter 10 typically further includes couplers, or first-to-second panel driving means, for allowing the first protective panel 44 to drive the second protective panel 46 towards its panel open position when the first protective panel 44 is moved towards its panel open position and reaches a predetermined positional relationship relative to the second protective panel 46, for example when the first and second protective panels 46 are substantially in register with each other, on in other words overlap completely or along a major portion thereof. This positional relationship may be preserved in some embodiments until the first and second protective panel achieve the open configuration.

The shelter 10 typically still further includes additional couplers for allowing the first protective panel 44 to drive the second protective panel 46 towards the its panel closed position when the first protective panel 44 is moved towards its panel closed position and reaches a predetermined position relative to the second protective panel 46, for example when the first and second protective panels are offset from each other so that only a minor portion thereof overlap, for example only a portion thereof occupied by the couplers. This positional relationship may be preserved in some embodiments until the first and second protective panel achieve the closed configuration.

The couplers may thus be provided along the opposed lateral edges of the protective panels.

Figure 10:
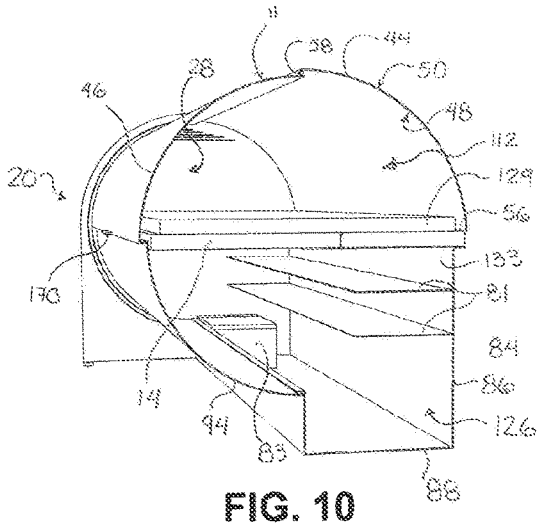
FIG. 10: in a partial perspective view with sections taken out illustrates the shelter of FIG. 1 with its roof in the closed configuration.

More specifically, referring for example to FIG. 10, the first protective panel 44 defines a first panel inner surface 48 and a first panel outer surface 50. Similarly, the second protective panel 46 defines a second panel inner surface 52 and a second panel outer surface 54.

In the illustrated embodiment of the invention, the couplers take the form of lips which are now described in further details. However, coupling could be performed in any other suitable manner that provides mechanical coupling between the first and second protective panels 44 and 46 at predetermined positional relationships between the first and second protective panels 44 and 46. For example, the first protective panel 44 has a first panel first lip 56 protruding from the first panel inner surface 48. The first panel first lip 56 is configured and sized for engaging with the second protective panel 46 for allowing the first protective panel 44 to drive the second protective panel 46 towards the open configuration when the first protective panel 44 is moved towards the open configuration and reaches a predetermined first panel opening driving position located between the open and closed panel positions of the first protective panel 44.

In the illustrated embodiment, the first protective panel 44 also has a first panel second lip 58 protruding from the first panel inner surface 48. The first panel second lip 58 is configured and sized for engaging with the second protective panel 46 for allowing for allowing the first protective panel 44 to drive the second protective panel 46 towards the closed configuration when the first protective panel 44 is moved towards the closed configuration and reaches a predetermined first panel closing driving position located between the open and closed panel positions of the first protective panel 44.

In the illustrated embodiment of the invention, the second protective panel 46 has a second panel first lip 60 protruding from the second panel outer surface 54. The second panel first lip 60 is configured and sized for engaging with the first protective panel 44 for allowing the second protective panel 46 to drive the first protective panel 44 towards the open configuration when the second protective panel 46 is moved towards the open configuration and reaches a predetermined second panel opening driving position located between the open and closed panel positions of the second panel.

The second panel first lip 60 can also be configured and sized for engaging with the first protective panel 44 for allowing the second protective panel 46 to drive the first protective panel 44 towards the closed configuration when the second protective panel 46 is moved towards the closed configuration and reaches a predetermined second panel closing driving position located between the open and closed panel positions of the second panel.

Referring for example to FIG. 9, the first protective panel 44 typically has a substantially elongated configuration with a substantially arcuate lateral cross-sectional configuration defining a first protective panel first longitudinal end 62 and first protective panel second longitudinal end 64. The first protective panel also defines a first protective panel first transversal end 66 and a substantially opposed first protective panel second transversal end 68.

Similarly, the second protective panel 46 typically has similar configuration defining a second protective panel first longitudinal end 70 and a second protective panel second longitudinal end 72. The second protective panel 46 also defines a second protective panel first transversal end 74 and a substantially opposed second protective panel second transversal end 76.

The first panel first lip 56 typically protrudes from the first panel inner surface 48 substantially adjacent the first protective panel first transversal end 66 from the first protective panel first longitudinal end 62 to the first protective panel second longitudinal end 64.

The first panel second lip 58 typically protrudes from the first panel inner surface 48 substantially adjacent to the first protective panel second transversal end 68 from the first protective panel first longitudinal end 62 to the first protective panel second longitudinal end 64.

The second panel first lip 60 typically protrudes from the second panel outer surface 54 substantially adjacent to the second protective panel first transversal end 74 from the second protective panel first longitudinal end 70 to the second protective panel second longitudinal end 72.

When the second protective panel 46 is in its open panel position and the first protective panel 44 is moved from its closed panel position towards its panel open position, the first panel first lip 56 eventually pushes against the second panel first lip 60 causing the first protective panel 44 to drive the second protective panel 46 towards the open configuration.

Inversely, when the second protective panel 46 is its closed panel position and the first protective panel 44 is moved from its closed panel position towards its open panel position, the first panel second lip 58 eventually pushes against the second panel first lip 60 causing the first protective panel 44 to drive the second protective panel 46 towards the closed configuration.

In the illustrated embodiment, the first panel first lip 56 is spaced from the first protective panel first transversal end 66 so as to define a lip-to-end inner surface segment 78. The supporting component 14 is positioned relative to the first protective panel 44 so that when the latter is in the first panel first position, the first panel first lip 56 abuttingly contacts the main supporting surface 16 adjacent the supporting component first transversal end 36 and the lip-to-end inner surface segment 78 is in a proximal relationship relative to the supporting component first transversal surface 40.

The supporting component 14 defines a supporting component opposed surface 80 located substantially opposite the main supporting surface 16. The shelter 10 typically further includes a shelve component 82 located underneath the supporting component 14. The shelve component 82 together with supporting component 14 define a storage space adapted to allow the intended user to place items thereinto.

In one embodiment of the invention, the shelve component 82 extends from the supporting component opposed surface 80. The shelve component is typically configured and sized so as to prevent access thereinto from a front side 84 of the shelter 10. The shelve component 82 may have any suitable shape without departing from the scope of the present invention. In the illustrated embodiment, the shelve component 82 includes a shelve front wall segment 86 and a shelve bottom wall segment 88.

The shelve component 82 defines a shelve rear edge 90. The shelve rear edge 90 is spaced from the supporting component opposed surface 80 so as to define a shelve access mouth 92 therebetween. Typically, the shelve rear edge 90 extends from a shelve rear wall segment 89.

In one embodiment of the invention, the shelve component 82 is provided with at least one horizontal shelf 81 for supporting personal items or the like. In one embodiment of the invention, the shelter 10 is further provided with storage compartments 83 for isolating potentially smelly or wet items such as shoes or the like. The shelter 10 could also be provided with a valuable item lockable storage box 85 secured to the shelter 10 for securely storing valuable items such as watches, jewelry, or the like.

The shelter 10 typically further includes a third protective panel 94. The third protective panel 94 is configured, sized and positioned for selectively blocking the shelve access mouth 92 so as to selectively prevent access to the items stored on the shelve component 82 and to act as a door to access an enclosed storage space defined by the supporting component 14, shelve component 82 and third protective panel 94.

The third protective panel 94 is slidably mounted to the first end wall inner surface 24 and the second end wall inner surface 28 for slidable movement in a substantially arcuate movement pattern between a third panel blocking position wherein the third protective panels 94 blocks the shelve access mouth 92 and a third panel access position wherein the third protective panel 94 at least partially clears the shelve access mouth 92 for allowing access to the storage compartment underneath the supporting component from a rear side of the shelter 10.

Figure 3:
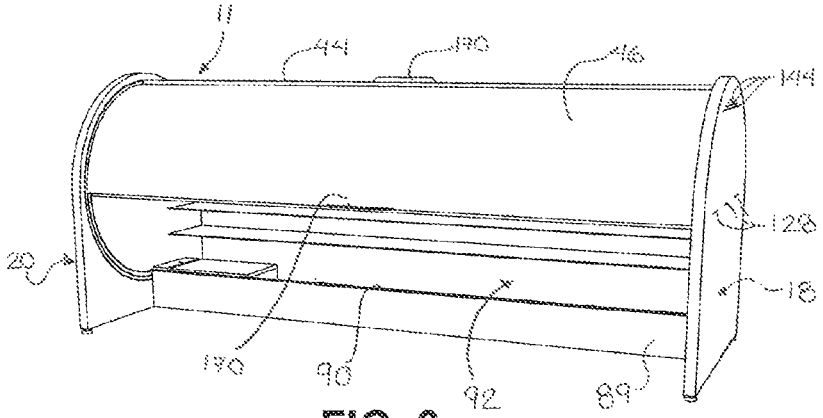
FIG. 3: in a perspective view illustrates the shelter of FIG. 1 with a door of a storage section thereof in an open position to allow access to the storage section.
Figure 4:
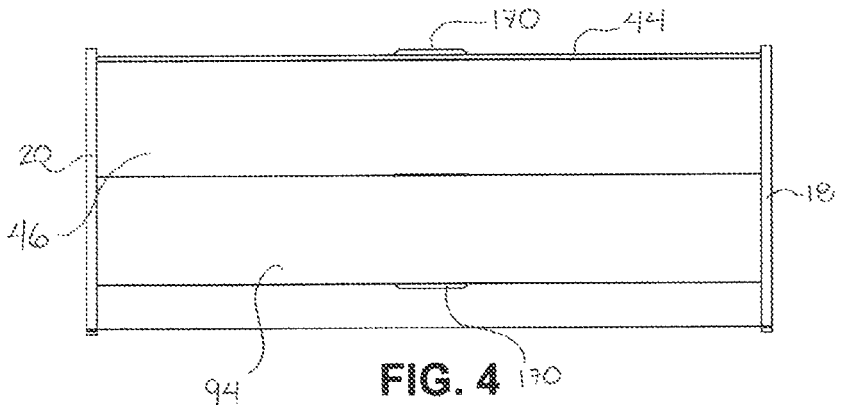
FIG. 4: in an elevational view illustrates the shelter of FIG. 1 with its roof in the closed configuration.
Figure 5:
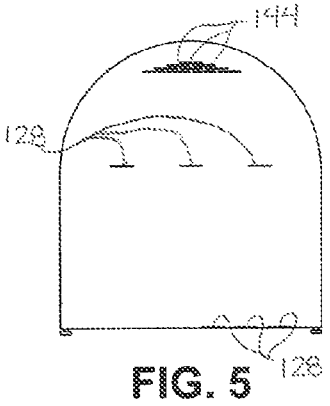
FIG. 5: in a side view illustrates the shelter of FIG. 1 with its roof in the closed configuration.

As shown in FIG. 3, when the roof 11 is in the closed configuration and the third blocking means is unlocked, the third protective panel 94 can be moved towards the third panel access position.

In the illustrated embodiment of the invention, the second protective panel 46 also has a second panel second lip 96 protruding from the second panel inner surface 52. The second panel second lip 96 typically extends from the second panel inner surface 52 substantially adjacent to the second protective panel second transversal end 76.

The third protective panel 94 defines a third panel inner surface 98 and a third panel outer surface 100. The third protective panel 94 typically has a substantially elongated configuration defining a third protective panel first longitudinal end 102 and a third protective panel second longitudinal end 104. The third protective panel 94 also defines a third protective panel first transversal end 106 and a substantially opposed third protective panel second transversal end 108.

In the illustrated embodiment of the invention, the third protective panel 94 also has a third panel lip 110 protruding from the third panel inner surface 98. The third panel lip 110 typically extends from the third panel outer surface 100 substantially adjacent to the third protective panel second transversal end 108.

Figure 11:
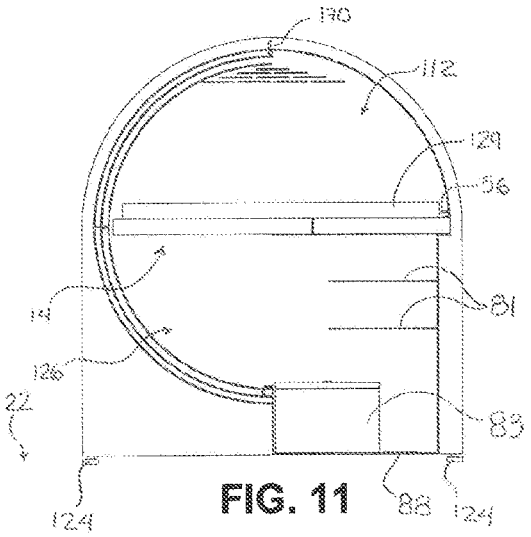
FIG. 11: in a partial side view with sections taken out illustrates the shelter of FIG. 1 with its roof in the closed configuration.

As shown more specifically in FIGS. 10 and 11, the first protective panel 44, the second protective panel 46, the third protective panel 94, the shelve component 82, the first end wall 18 and the second end wall 20 are typically configured, sized and positioned so as to define a substantially enclosed human chamber 112 when the first protective panel 44 is in the first panel first position, the second protective panel 46 is in the second panel first position and the third protective panel 94 is in the third panel closed position.

Figure 14:
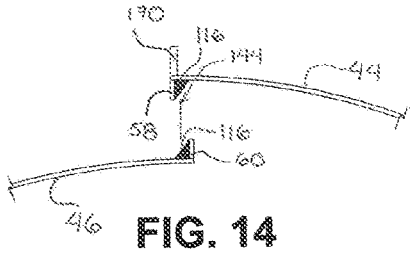
FIG. 14: in a partial side view with sections taken out illustrates the relationship between the end sections of some protective panels part of the shelter of FIG. 1.

Referring to FIG. 14, In one embodiment of the invention, the first panel second lip 58 and the second panel first lip 60 are typically configured, positioned and sized so as to create a first panel second lip-to-second panel first lip spacing 114 therebetween. The first panel second lip-to-second panel first lip spacing 114 is typically calibrated so as to allow air to flow into the shelter 10 while at least partially preventing liquids such as water from rain from penetrating into the shelter 10 when the first protective panel 44 is in the first panel first position and the second protective panel 46 is in the second panel first position.

Similarly, in one embodiment of the invention, the third panel lip 110 and the second panel second lip 96 are typically configured, positioned and sized so as to create a second panel second lip-to-third panel lip spacing therebetween. The second panel second lip-to-third panel lip spacing is typically calibrated so as to allow air to flow into the shelter 10 while at least partially preventing liquids such as water from rain from penetrating into the shelter 10 when the second protective panel 46 is in the second panel first position and the third protective panel 94 is in the third panel closed position.

Figure 15:
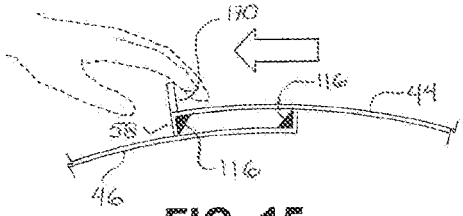
FIG. 15: in a partial side view with sections taken out illustrates the relationship between the end sections of some protective panels part of the shelter of FIG. 1.

As illustrated in FIGS. 14 and 15, in one embodiment of the invention, the shelter 10 could also be provided with abutment components 116, or seals, mounted on corresponding panel lips for providing a liquid-tight seal. The abutment components 116 also allow for a smoother contact between the corresponding lips. Typically, the abutment components 116 may be formed out of a substantially resilient material such as an elastomeric material or the like. The abutment components 116 may have any suitable shape such as the triangular cross-sectional configuration illustrated in FIGS. 14 and 15.

To enhance the experience of the intended user, at least part of the inner surface of at least one of the first or second protective panels 44 and 46 may be provided with a source of visual content. The source of visual content could be positioned such that the intended user is able to have visual access to it when lying in a supine or side position on the supporting component 14 within the human chamber 112.

For example, a segment of at least one of the first or second protective panels 44 or 46 may be provided with a static source of visual content such as a painting, a drawing, a picture or the like. A segment of at least one of the first or second protective panels 44 and 46 may alternatively be provided with a dynamic source of visual content such as an electronic screen or the like.

To enhance the experience of the intended user, at least part at least one of the first or second protective panels 44 and 46 may also be provided with a window. The window could be positioned such that the intended user is able to have visual access to it when lying in a supine or side position on the supporting component 14 within the human chamber 112.

The window could be made of a translucent or transparent material. The window could be provided with a removable window cover for allowing the intended user to selectively block the window.

To enhance the experience of the intended user, the shelter 10 could further be provided with an interior lighting means. The interior lighting means could take any suitable form such as LEDs or the like attached or embedded in the interior surface of at least one of the first or second protective panels 44 and 46. The lighting means could be powered by any suitable powering means including a battery or solar panels mounted on the exterior surface of the shelter 10.

To enhance the experience of the intended user, the shelter 10 could also still be provided a cushioning component 129 for cushioning the main supporting surface of the supporting component 14. The cushioning component 129 could take any suitable form such as a mattress or similar padding. The cushioning component 129 could be fixedly or releasably secured to the supporting component 14 by any suitable means. The cushioning component 129 is preferably made of weatherproof and fire-resistant material. The cushioning component 129 is may be made of a material that can be easily cleaned. The cushioning component 129 is typically made of a material that can be hosed for cleaning purposes.

The first, second and third protective panels 44, 46 and 94 are movably attached to the first and second end wall inner surfaces 24 and 28 by any suitable means. In the illustrated embodiment, the first and second end wall inner surfaces 24 and 28 are provided with a first panel groove 118, a second panel groove 120 and a third panel groove 122 formed therein. The first, second and third panel grooves 118, 120 and 122 span larger angles than the first, second and third protective panels 44, 46 and 94 so that the latter are movable along the former.

Figure 12:
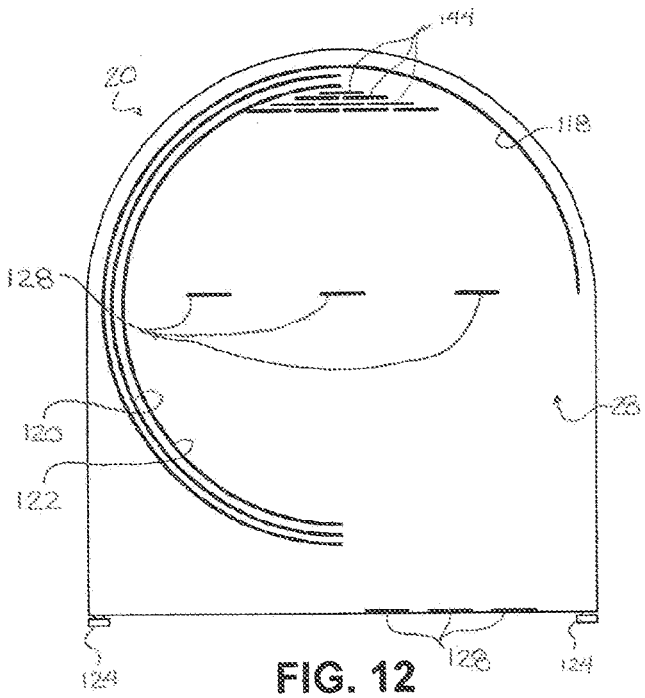
FIG. 12: in a partial side view with sections taken out illustrates the interior of a side wall with its grooves part of the shelter of FIG. 1.
Figure 13:
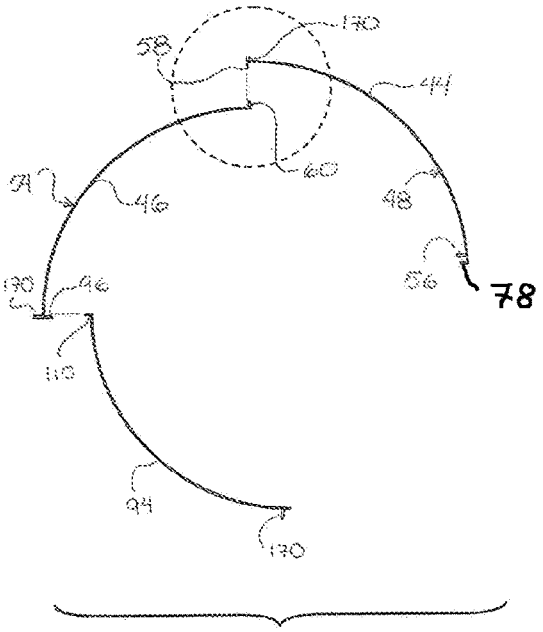
FIG. 13: in a partial side view with sections taken out illustrates the relationship between some protective panels part of the shelter of FIG. 1.

As shown more particularly in FIG. 12, the first, second and third panel grooves 118, 120 and 122 typically have a generally arcuate configuration and are concentrically positioned relative to each other. Typically, the first panel groove 118 is the outermost located, the third panel groove 122 the innermost located and the second panel groove 120 is located therebetween. Therefore, the first, second and third panel grooves 118, 120 and 122 have decreasing radii of curvature in that order. The same relationship between radii of curvature is maintained for the first, second and third protective panels 44, 46 and 94.

In the illustrated embodiment, the first panel groove 118 extends over an arc segment of approximately 270 degrees while the second and third panel grooves 120 and 122 extend over an arc segment of approximately 180 degrees. It should however be understood that the first, second and third panel grooves 118, 120 and 122 could extend over other arc segment ranges without departing from the scope of the present invention.

Figure 19:
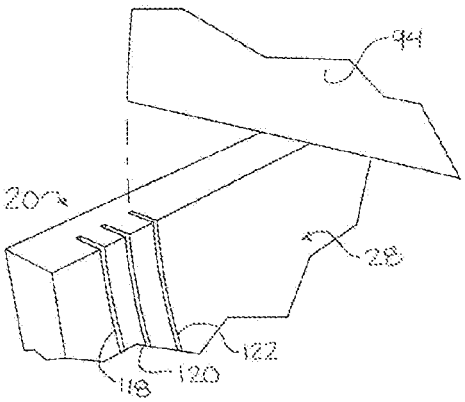
FIG. 19: in a partial perspective view with sections taken out illustrates the relationship between a protective panel and a corresponding groove formed in a side wall of the shelter of FIG. 1.

FIG. 19 illustrates an embodiment of the invention wherein the first, second and third panel grooves 118, 120 and 122 have a generally rectangular cross-sectional configuration for substantially fittingly receiving a portion of the corresponding first, second and third protective panels 44, 46 and 94 adjacent their respective longitudinal ends.

Figure 20:
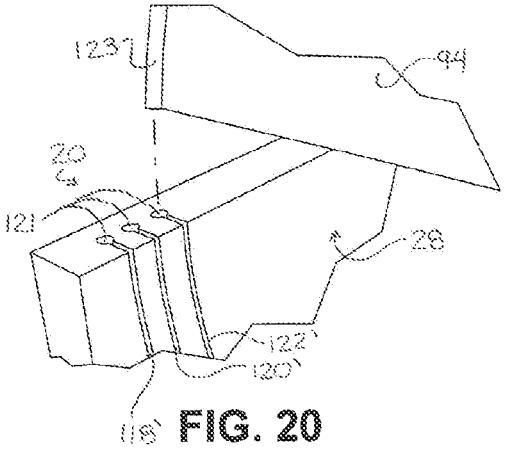
FIG. 20: in a partial perspective view with sections taken out illustrates the relationship between a protective panel and the corresponding groove formed in a side wall of an alternative shelter similar to the shelter of FIG. 1.

FIG. 20 illustrates an alternative embodiment of the invention wherein the first, second and third panel grooves 118', 120' and 122' are further provided with a terminal groove enlargement portion 121 for substantially fittingly receiving a corresponding panel enlargement portion 123 of the corresponding first, second and third protective panels 44, 46 and 94 adjacent their respective longitudinal ends.

Figure 21:
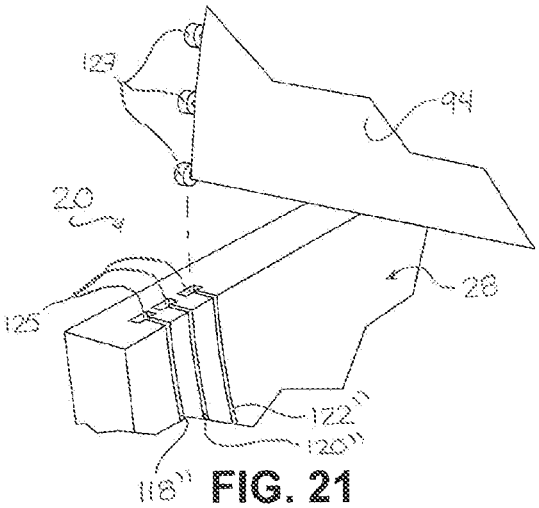
FIG. 21: in a partial perspective view with sections taken out illustrates the relationship between a protective panel and the corresponding groove formed in a side wall of another alternative shelter similar to the shelter of FIG. 1.
Figure 22:
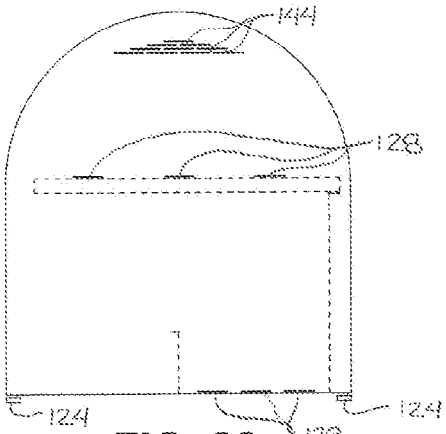
FIG. 22: in a side view illustrates a side wall part of the shelter of FIG. 1.

FIG. 21 illustrates an embodiment of the invention wherein the first, second and third panel grooves 118", 120" and 122" are further provided with a terminal prong receiving portion 125 for substantially fittingly receiving a corresponding panel prong 127. The panel prong 127 may take any suitable form. In one embodiment of the invention, the panel prong 127 includes a roller component or bearings for reducing friction with the prong receiving portion 125. Typically the panel prong 127 is rollably mounted to the corresponding first, second and third protective panels 44, 46 and 94 adjacent their respective longitudinal ends for facilitating the slidable movement of the first, second and third protective panels 44, 46 and 94.

The first, second and third panel grooves 118, 120 and 122 may have various cross-sectional configurations without departing from the scope of the present invention. Also, various other means could be used for facilitating the slidable movement of the first, second and third protective panels 44, 46 and 94 without departing from the scope of the present invention.

The shelter 10 is optionally further provided with a set of leveling legs 124. The leveling legs 124 are provided with a leg length adjustment means for allowing adjustment of the length thereof. The leveling legs 124 are adapted to be used for maintaining the supporting component 14 leveled when the ground 22 is uneven. Optionally, the leveling legs 124 could be provided with caster-type wheels or the like for facilitating displacement of the shelter 10.

The shelter 10 is designed so that minimal moisture and, in particular, no rainwater or surface water can penetrate into the human chamber 112. Similarly, the shelter 10 is preferably also designed so that the shelve component 82 and the third protective panel 94 together define a secure and watertight item chamber 126 for protectively enclosing the personal items of the user.

Figure 23:
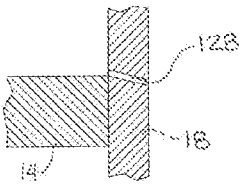
FIG. 23: in a partial cross-sectional view with sections taken out illustrates a draining channel formed in the wall of FIG. 22

The shelter 10 is typically provided with drainage apertures 128 strategically positioned to allow drainage of liquids either accidentally spilled or deliberately poured into the human or item chambers 112 and 126. The drainage apertures 128 are thus particularly useful when the human and item chambers 112 and 126 are cleaned by being hosed or otherwise. As shown more specifically in FIG. 23, the drainage apertures 128 are typically angled so as to facilitate the drainage of liquids while preventing unwanted inward flow of liquids.

The substantially tubular configuration of the shelter 10 is associated with many advantages beyond its aesthetically pleasing effect. For example, the generally arcuate configuration of some of its components, including the first, second and third protective panels 44,46 and 94 facilitates cleaning of both the interior and exterior surfaces as cleaning liquids will have a tendency to trickle down. The ease of cleaning is a particularly important feature when the shelter is used for sheltering homeless persons that sometimes have difficulty gaining access to means for ensuring their basic hygienic needs.

Also, the generally arcuate configuration of some of its components, including the first, second and third protective panels 44, 46 and 94 provides relatively smooth internal and external surface with minimal corners and edges to avoid injuring users. This is also an important feature for homeless persons that could be prone to falling or otherwise impacting the shelter 10 because of health or substance related problems.

Furthermore, the generally arcuate configuration of some of its components, including the first, second and third protective panels 44, 46 and 94 allows for air movement such as the wind to flow thereonto with minimal resistance. Accordingly wear, noise and the risk of having the shelter 10 displaced by strong winds is minimized.

The shelter 10 is particularly well adapted to be used in specifically designated interior environments. For example, the shelter 10 is designed to be installed in the underground network of passageways of urban areas. Some urban areas have underground networks of passageways that provide access, for example, to subways or commercial space. These underground networks typically remain with a controlled climate during underutilized periods such as during the night.

In such instances, the shelter 10 can easily be used at night in its bed configuration shown in FIG. 26 for providing homeless persons with a private and safe personal environment to sleep and store their belongings. During the day, the shelter 10 can easily be converted to its bench configuration shown in FIG. 27 allowing any intended user to sit thereon.

Figure 24:
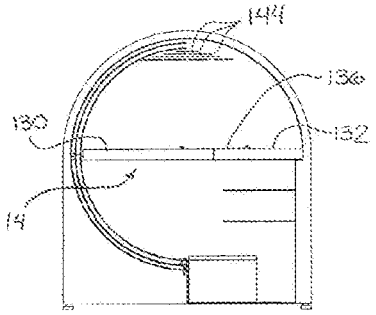
FIG. 24: in a partial side view with sections taken out illustrates a supporting component part of the shelter of FIG. 1 in a bed configuration.
Figure 25:
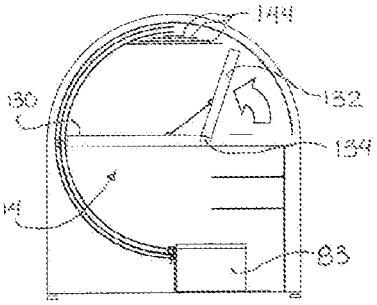
FIG. 25: in a partial side view with sections taken out illustrates the supporting panel in a bench configuration.

In the embodiment of the invention illustrated more specifically in FIGS. 24 and 25, the supporting component 14 includes a supporting component first section 130 and a supporting component second section 132 pivotally attached together by a hinge 134, The hinge 134 allows pivotal movement of the supporting component second section 132 between a bed configuration shown in FIG. 24 and a bench configuration shown in FIG. 25.

When in the bed configuration, the supporting component first section 130 and the supporting component second section 132 are substantially aligned relative to each other and co-planar so as to provide a substantially flat bed surface. When in the bench configuration the supporting component first section 130 and the supporting component second section 132 are substantially angled relationship relative to each other so that the supporting component first section 130 may act as a bench seat portion while the supporting component second section 132, which extends angled upwardly at an angle from the supporting component first section 130, may act as a bench back rest, as shown in FIG. 27.

In one embodiment of the invention, releasable angle maintaining means such as at least one angle maintaining component 136 is provided for releasably maintaining the angles relationship between the supporting component first section 130 and the supporting component second section 132.

In one embodiment of the invention, the angle maintaining component includes an angle maintaining rod pivotally attached at one end to supporting component first section 130. The angle maintaining rod is adapted to be releasably attached to supporting component second section 132 for maintaining the latter in an angled relationship relative to the supporting component first section 130 when the supporting component second section 132 is used as a bench back rest, as shown in FIG. 27.

In one embodiment of the invention, the shelter 10 is further provided with a protective segment 133 extending from the front wall segment 86 for protecting the interior of the item chamber 126 when the supporting component second section 132 is in an angled relationship relative to the supporting component first section 130.

The shelter 10 could also be used in other context such as in the context of an environment without climate control without departing from the scope of the present invention. In an alternative embodiment of the invention, the shelter 10 is provided with thermal insulation means for thermally insulating at least the human chamber 112 and in some instances also the item chamber 126.

The thermal insulating means may take any suitable form. In one embodiment of the invention, the supporting component 14 and the first, second and third protective panels 44, 46 and 94 include at least two layers of material spaced apart from each other. The spacing between the layers defines at least one, preferably several hollow chambers which are separated from one another. The chambers may be filled with aft or a thermally insulating material.

In one embodiment of the invention, the thermally insulated human chamber 112 is heated up by the body heat of the human lying therein. In yet another embodiment of the invention adapted for use in particularly harsh weather conditions, additional heating means can be provided for heating the human and item chambers 112 and 126. The heating means may take any suitable form such as electrical or chemical heating elements. The heating elements when of the electrical type, in turn, may be powered by any suitable means such as a battery or solar panels mounted on the shelter 10 or adjacent to it.

Alternatively, a sleeping bag or a sleeping envelope, a thermal blanket or a sleeping cover arranged in the human chamber 112 can also be provided. The sleeping bag or the sleeping envelope could be releasably or non-releasably connected to the shelter 10 without departing from the scope of the present invention.

In yet another embodiment of the invention wherein the shelter 10 is adapted for use in an environment wherein the temperature is relatively high, venting openings 144 may be provided in the first and/or second end walls 18 and 20, the shelve component 82 and the first, second or third protective panels 44, 46, 92. The venting openings 144 may also be provided for providing proper ventilation regardless of the weather.

The venting openings 144 may be located in the head region and/or foot region or any other suitable location. In one embodiment of the invention, a pair of venting openings 144 are strategically positioned to create a venting pattern of aft circulation, for example by using the propensity for warmer aft to rise.

The venting openings 144 can be shielded to the outside by way of a suitable awning or the like as a minimum weather protection, viewing protection and light protection. The connection locations of the awnings to the first and second protective panels 44, 46 are preferably designed in a watertight manner. The awning may include a vent closing plate (not shown) pivotally or slidably mounted to the interior or exterior surfaces of the first and second protective panels 44, 46 for movement between an opening obstructing position wherein the vent closing plate at least partially obstructs the venting openings 144 and an opening clearing position wherein the vent closing plate at least partially clears the venting openings 144.

In an embodiment of the invention illustrated in FIGS. 29 through 35, the shelter 10 is further provided with a screen panel 138 acting as a mosquito screen. The screen panel 138 is typically slidably mounted to the first end wall inner surface 24 and the second end wall inner surface 28 for slidable movement in a substantially arcuate movement pattern between a deployed screen panel position shown in FIG. 31 wherein the screen panels 138 is in a substantially overlying relationship relative to at least a portion of the supporting component 14 and a retracted screen panel position shown in FIG. 30 wherein the screen panel 138 is at least partially retracted from at least a portion of the supporting component 14 to allow access to the main supporting surface 16.

Figure 31:
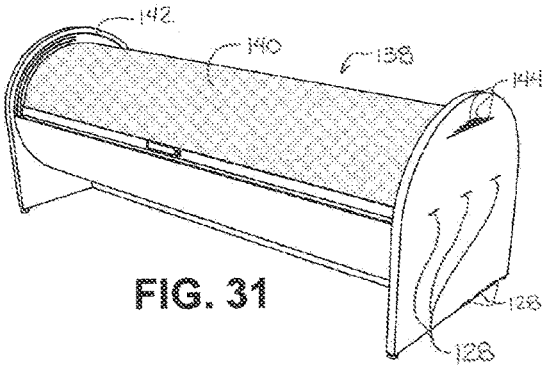
FIG. 31: is a perspective view of the shelter of FIG. 30 with the screen panel shown in a deployed screen panel configuration.

When in the deployed screen panel position shown in FIG. 31, the screen panels 138 is adapted to cover the human chamber 112 to keep leaves, debris, spiders, insects, birds, and other animals from entering the human chamber 112 without blocking fresh air-flow. Hence, an intended user lying on the supporting surface 16 may wish to leave the first and second protective panels in their respective retracted or second position while taking advantage of the screen panel in its deployed configuration.

The screen panel 138 typically includes a screen mesh 140 made out of a suitable material such as plastic, polyester, nylon, aluminum, bronze or fiberglass wire. In one embodiment of the invention, finer mesh is used to prevent very small insects, often called "noseeums" from flying through. The finer mesh screens are also used to prevent pollen and allergens from entering the human chamber 112 in order to control allergic reactions.

The screen panel 138 is movably attached to the first and second end wall inner surfaces 24 and 28 by any suitable means. In the embodiment illustrated in FIGS. 29 through 31, the first and second end wall inner surfaces 24 and 28 are further provided with a screen panel groove 142 formed therein.

Figure 29:
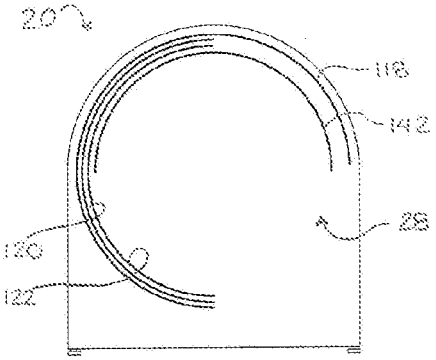
FIG. 29: is an interior side view of the end wall of FIG. 22
Figure 30:
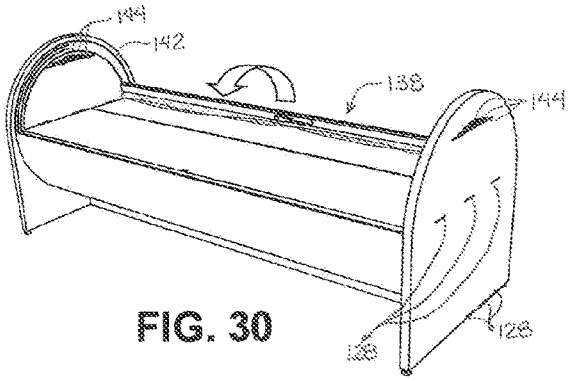
FIG. 30: is a perspective view of a shelter similar to the shelter of FIG. 1 having a screen panel, the screen panel being shown in a retracted screen panel configuration.

As shown more particularly in FIG. 29, the screen panel groove 142 typically has a generally arcuate configuration and is concentrically and inwardly positioned relative to the third panel groove 122.

In the illustrated embodiment, the screen panel groove 142 extends over an arc segment of approximately 180 degrees. It should however be understood that the screen panel groove 142 could extend over other arc segment range without departing from the scope of the present invention.

Figure 32:
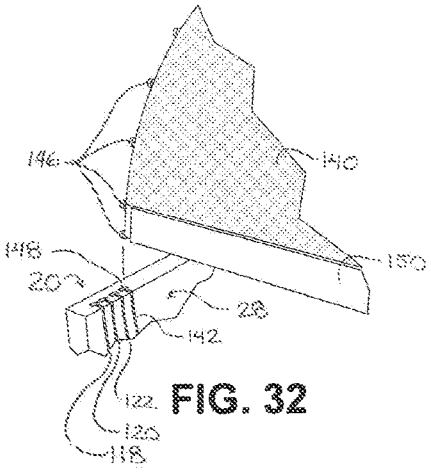
FIG. 32: in a close-up partial perspective view with sections taken-out illustrates the shelter of FIG. 30, the view showing a portion of the screen panel and a portion of a side wall having a corresponding screen panel groove.

As illustrated in FIG. 32, in one embodiment of the invention the screen panel 138 is provided with screen retaining prongs 146 extending from the longitudinal ends of the screen mesh 140. The screen retaining prongs are adapted to be slidably movable within corresponding screen retaining enlargements 148 formed in the screen panel groove 142. The screen retaining prongs may take any suitable form. In one embodiment of the invention, the screen retaining prongs include roller component or bearings for reducing friction with the screen panel groove 142.

The screen panel 138 is typically further provided with a screen framing component 150. The screen framing component 150 typically includes at least one screen framing plate having a substantially elongated configuration and is typically attached to the screen mesh 140 adjacent at least one of its transversal ends.

The screen panel 138 is typically provided with a screen handle for facilitating handling of the screen panel 138 between the deployed screen panel position and the retracted screen panel position. The screen panel may take any suitable form. In the illustrated embodiment, the screen handle includes a screen handle aperture 152 formed in the screen framing component 150. The screen handle aperture 152 is typically configured, sized and position for allowing ergonomical insertion of a portion of the hand of the intended user therein.

The screen panel 138 is typically further provided with a screen lock for releasably locking the screen panel 138 in the deployed screen position. Typically, the screen lock allows an intended user to lock the screen panel 138 in the deployed screen position whether the user is located inside or outside of the human chamber 112.

The screen lock may take any suitable form. In the illustrated embodiment, as seen for example in FIG. 35, the screen lock included a screen locking tongue 154 extending from the screen framing component 150 and a screen locking groove 156 formed in the supporting surface 16. The screen locking tongue 154 is releasably insertable into the screen locking groove 156 for releasably locking the screen panel 138 in the deployed screen position.

The screen locking tongue 154 is typically inserted and retracted from the screen locking groove 156 using a screen locking lever 158 pivotally mounted to the interior surface of the screen framing component 150. Pivotal movement of the screen locking lever 158 allows an intended user located inside the human chamber 112 to ergonomically move the screen locking tongue 154 in and out of locking engagement with the screen locking groove 156.

Figure 33:
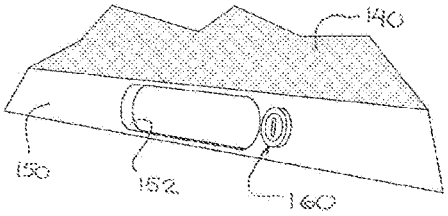
FIG. 33: in a close-up partial perspective view with sections taken-out illustrates the shelter of FIG. 30, the view showing a portion of the screen panel locking mechanism from the outside.
Figure 34:
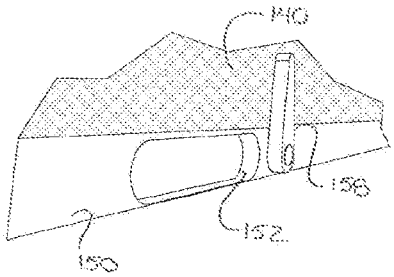
FIG. 34: in a close-up partial perspective view with sections taken-out illustrates the shelter of FIG. 30, the view showing a portion of the screen panel locking mechanism from the inside with the locking mechanism in an unlocked configuration.
Figure 35:
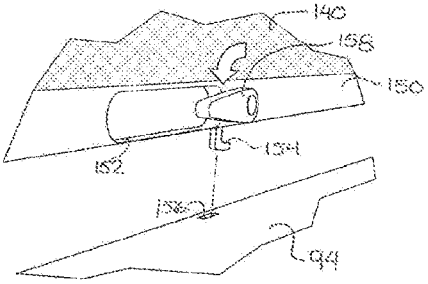
FIG. 35: in a close-up partial perspective view with sections taken-out illustrates the shelter of FIG. 30, the view showing a portion of the screen panel locking mechanism from the inside with the locking mechanism in a locked configuration.

Typically, the screen lock also includes an exterior locking component 160 for allowing an intended user to releasably move the screen locking tongue 154 in and out of locking engagement with the screen locking groove 156. As shown in FIG. 33, the exterior locking component 160 could take the form of a conventional key operated locking component. The exterior locking component could also take the form of a combination activated locking component or any other suitable lock without departing from the scope of the present invention.

Alternatively, or in combination, the shelter 10 can be provided with a fan or cooling unit (not shown). The tan or cooling unit, in turn, may be powered by any suitable means such as a battery or solar panels mounted on the shelter 10 or adjacent to ft.

The shelter 10 is typically provided with a panel manipulating means for facilitating the manipulation of at least one of the first, second and third protective panels 44, 46 and 94 between their respective first and second positions. In one embodiment of the invention, the panel manipulating means includes a manipulating indentation recess, indentation or concavity formed on the interior or external surfaces of either one of the first, second and third protective panels 44, 46 and 94. The panel manipulating means could take any other suitable form such as a protruding handle or the like without departing from the scope of the present invention.

FIGS. 1 through 15 illustrate an embodiment of the invention wherein the panel manipulating means includes at least one manipulating lip 170 extending from the exterior surface of a corresponding panel substantially adjacent at least one of its corresponding panel transversal end. It should be understood that the manipulating lip 170 could extend inwardly from a corresponding panel inner surface to provide means for manipulating the panel from within the human chamber without departing from the scope of the present invention. Also the manipulating lip 170 could have any other configuration without departing from the scope of the present invention.

Figure 16:
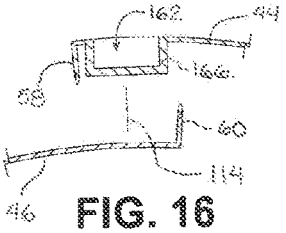
FIG. 16: in a partial cross-sectional view with sections taken out illustrates the relationship between the end sections of some protective panels part of a shelter similar to the shelter of FIG. 1.
Figure 17:
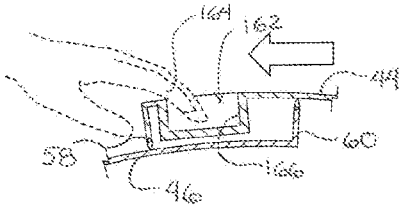
FIG. 17: in a partial cross-sectional view with sections taken out illustrates the relationship between the end sections of some protective panels part of a shelter similar to the shelter of FIG. 1 as shown in FIG. 16.

FIGS. 16 and 17 illustrate an embodiment of the invention wherein the panel manipulating means includes a manipulating recessed segment 162 formed in at least one of the first, second and third protective panels 44, 46 and 94, typically adjacent at least one of their respective transversal ends. The manipulating recessed segment 162 is configured and sized for allowing insertion therein of at least one portion of at least one finger 164 of an intended user. Typically, the manipulating recessed segment 162 has a generally rectangular configuration although the manipulating recessed segment 162 could have any other configuration without departing from the scope of the present invention.

When such an embodiment is used, the corresponding panels must be sufficiently spaced apart from each other to accommodate the manipulating recessed segment 162 without causing interference therewith. Also, the corresponding adjacent panel lips must have a sufficient length to maintain their function. Furthermore, the corresponding panels must overlap each other sufficiently to accommodate the manipulating recessed segment 162 without causing interference therewith. Typically, the corresponding panel grooves must also have a sufficient arc segment length to allow the corresponding panels to clear the edge of main supporting surface 16 when the shelter is in the bench configuration so as to prevent interference with the legs of the intended user.

By way of example, FIGS. 16 and 17 illustrate a manipulating recessed segment 162 protruding inwardly from the first protective panel 44 adjacent the first panel second lip 58. It should however be understood that the manipulating recessed segment 162 could be formed in any of the panels and could protruded inwardly or outwardly therefrom for allowing internal or external manipulation of the panels without departing from the scope of the present invention.

When a manipulating recessed segment 162 is used, the panel lip of the adjacent panel typically abuts against a recess abutment surface 166 instead of the lip of the panel in which the manipulating recessed segment 162 is formed. However other configurations allowing adjacent panel lips to continue abutting against each other could be used without departing from the scope of the present invention.

Figure 18:
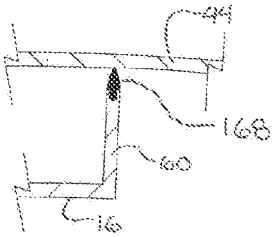
FIG. 18: in a partial cross-sectional view with sections taken out illustrates a sealing tip attached to a lip part of a shelter similar to the shelter of FIG. 1 as shown in FIG. 16.

As shown more specifically in FIG. 18, in one embodiment of the invention, at least one of the panel lips is provided with a lip tip sealing component 168 extending from the tip thereof. The lip tip sealing component 168 is adapted to provide a substantially liquid-tight seal with the adjacent surface of an adjacent panel. The lip tip sealing component 168 is typically made of a suitable deformable material such as an elastomeric resin, silicone or the like. Typically, the lip tip sealing component 168 is configured and sized for allowing passage of components such as the protruding portion of a locking mechanism or the like protruding from the surface of the adjacent panel.

The shelter 10 is preferably further provided with a panel lock for selectively locking at least one of the first, second and third protective panels 44, 46 and 94 in their respective second position.

The panel lock typically also includes a first panel lock for locking the first protective panel in its closed panel position so that the roof is locked in the closed configuration. The first panel lock is then a roof lock. In one embodiment of the invention, the first panel lock includes a first panel locking rod (not shown) slidably mounted to the supporting component for slidable movement between a first panel locking rod unlocked position wherein the first panel locking rod clears the first protective panel and a first panel locked position wherein the first panel locking rod contacts the first protective panel for releasably preventing movement of the first protective panel towards its panel open position.

Figure 36:
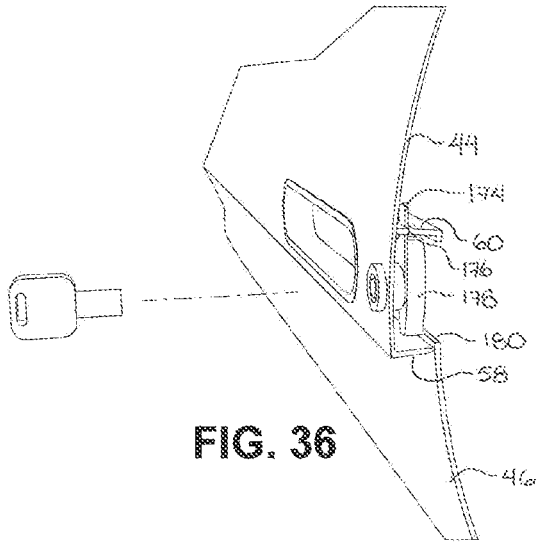
FIG. 36: in a close-up partial perspective view with sections taken-out illustrates a shelter similar to the shelter of FIG. 1 having a protective panel locking mechanism.
Figure 37:
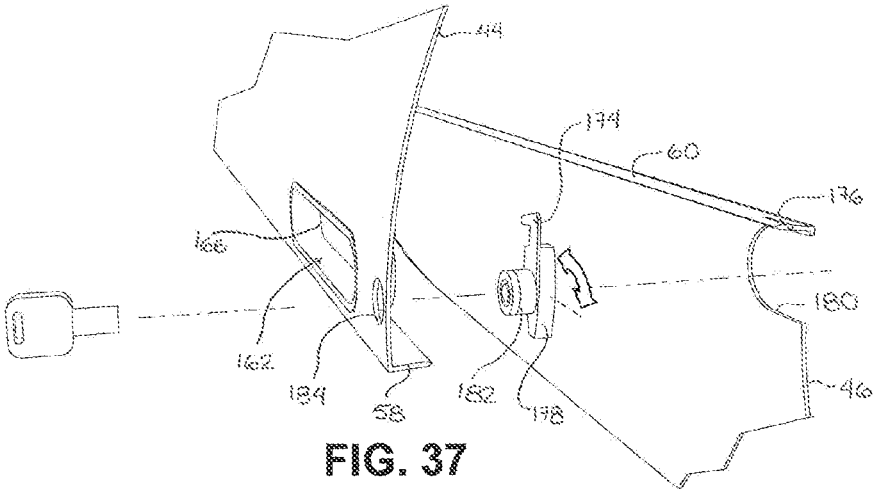
FIG. 37: in a close-up partial exploded view with sections taken-out illustrates the shelter of FIG. 36.
Figure 38:
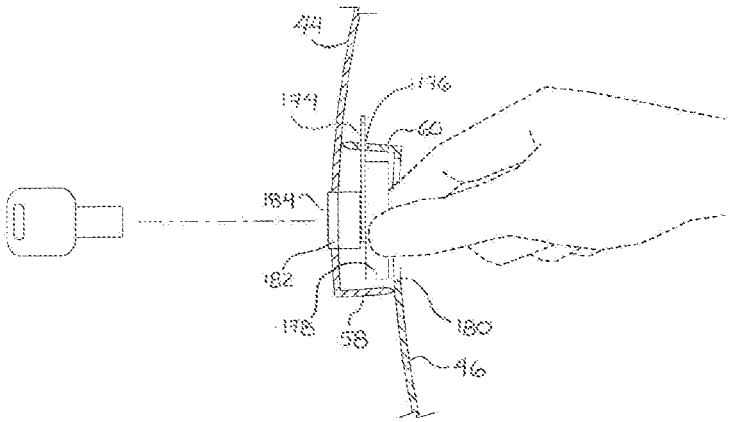
FIG. 38: in a close-up partial cross-sectional view with sections taken-out illustrates the shelter of FIG. 36.

FIGS. 36 through 38 illustrate an embodiment of the invention wherein the panel lock includes a panel locking tongue 174 pivotally mounted to a corresponding panel, such as first protective panel 44 and a panel locking groove 176 formed in the adjacent panel lip of the adjacent panel such as second panel first lip 60 of the second protective panel 46. The panel locking tongue 174 is releasably insertable into the panel locking groove 176 for releasably locking the first and second protective panels 44 and 46 together.

The panel locking tongue 174 is typically inserted and retracted from the panel locking groove 176 using a panel locking lever 178 attached to the panel locking tongue 174. A tongue access aperture 180 is formed in the adjacent panel such as second protective panel 46 to allow an intended user located in the human chamber 112 to manipulate the panel locking lever 178. Pivotal movement of the panel locking lever 178 hence allows an intended user located inside the human chamber 112 to ergonomically move the panel locking tongue 174 in and out of locking engagement with the panel locking groove 176.

Typically, the panel lock also includes an exterior locking component for allowing an intended user to releasably move the panel locking tongue 174 in and out of locking engagement with the panel locking groove 176. The exterior locking component is mounted to the panel by any suitable means. The exterior locking component could take the form of a conventional key operated locking component 182 extending through a locking component aperture 184. The exterior locking component could also take the form of a combination lock, a remote control lock or any other suitable lock without departing from the scope of the present invention.

It should be understood that although the panel lock is illustrated as being used for locking the first and second protective panels 44 and 46 together, it could also be used for locking the second and third protective panels 46 and 94.

In one embodiment of the invention, the panel lock includes a third panel lock. In one embodiment of the invention, the third panel lock typically includes a third panel locking rod (not shown) pivotally attached to the inner surface of the third panel for pivotal movement between a third panel locking rod unlocked position wherein it clears the supporting component 14 and a third panel locking rod locked position wherein the third panel locking rod is positioned for abuttingly contacting the undersurface of the supporting component for releasably preventing the third protective panel 94 towards the third protective panel first position.

In another embodiment of the invention, the third panel lock takes the form of a locking pin (not shown) slidably mounted to the supporting component 14 for selectively lockingly engaging a corresponding locking slot forms in the third protective panel.

Figure 39:
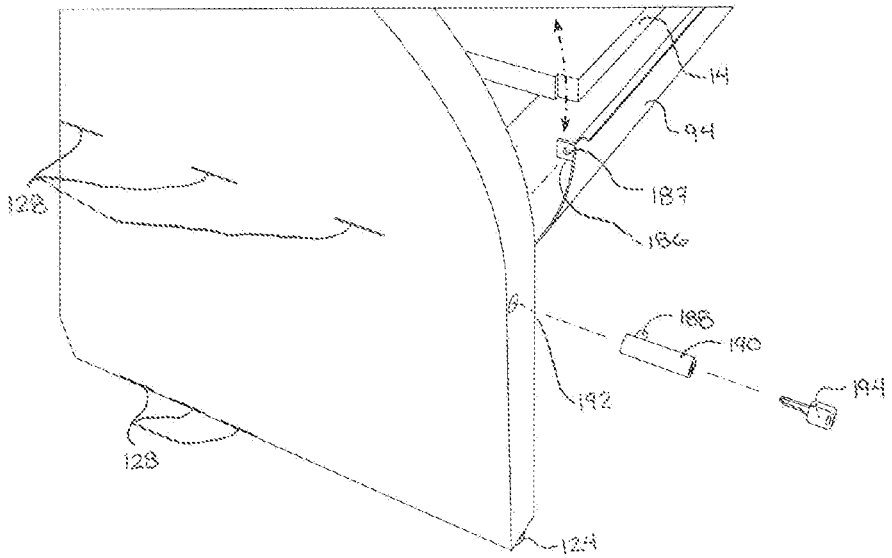
FIG. 39: in a close-up partial perspective view with sections taken-out illustrates a shelter similar to the shelter of FIG. 1 having a storage compartment panel locking mechanism.
Figure 40:
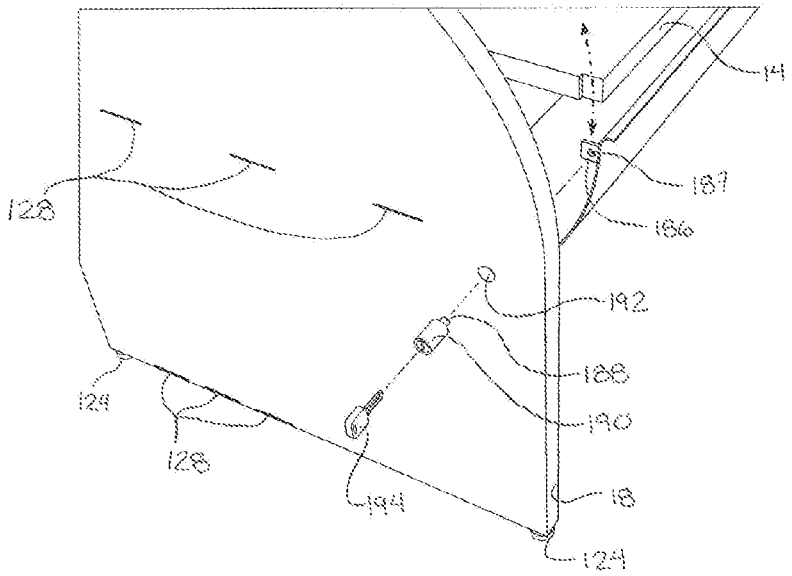
FIG. 40: in a close-up partial perspective view with sections taken-out illustrates the shelter of FIG. 1.

FIGS. 39 and 40 illustrate yet another embodiment of the invention wherein the third panel lock includes a locking plate 186 extending from the third protective panel 94. The locking plate 186 is provided with a locking aperture or recess 187. The third panel lock further includes a looking pin 188. The locking pin 188 is mounted to a locking mechanism 190 for releasably locking the third protective panel 94 by sliding the locking pin 188 into the locking aperture 187. The locking mechanism 190 is attached to one of the first or second end walls 18 or 20 and typically extends through a mechanism receiving aperture 192. The locking mechanism is adapted to allow selective movement of the locking pin in and out of the locking aperture using a key 194 or any other suitable means such as a combination activated or remote-control system.

Figure 28:
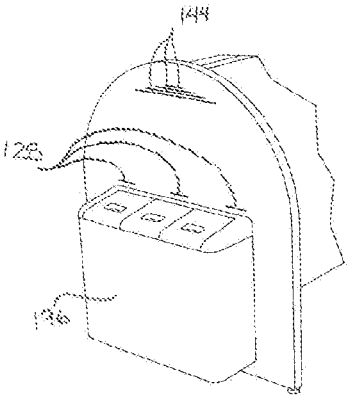
FIG. 28: in a partial perspective view with sections taken out illustrates waste bin part of a shelter similar to the shelter of FIG. 1.

As shown in FIG. 28, in one embodiment of the invention, the shelter 10 is further provided with a waste bin 196 typically releasably attached thereto. The waste bin 196 typically has separate compartments for receiving different types of waste such as recyclable waste, used syringes and the like.

Although the shelter 10 is illustrated as being configured and sized for use by a single human 12, in alternative embodiments of the invention, the shelter could be configured and sized for simultaneous use by more than one human 12.

The shelter 10 is typically made of a fire-resistant material. The shelter 10 is preferably also made of a soundproof or noise reducing material.

Although the present invention has been described hereinabove by way of exemplary embodiments thereof, it will be readily appreciated that many modifications are possible in the exemplary embodiments without materially departing from the novel teachings and advantages of this invention and without departing from the spirit and nature of the subject invention as defined in the appended claims. Accordingly, the scope of the claims should not be limited by the exemplary embodiments, but should be given the broadest interpretation consistent with the description as a whole.

What is claimed is:

1. A shelter comprising:

a supporting component having a main supporting surface configured and sized for supporting a human in a sleeping position, the supporting component defining substantially opposed supporting component first and second longitudinal ends;

a first end wall and a second end wall provided respectively at the supporting component first and second longitudinal ends;

a roof movable between a closed configuration and an open configuration, wherein, in the closed configuration, the roof is overlying the main supporting surface, and in the open configuration, the roof is at least partially retracted from the main supporting surface to allow outside access thereto; and a lock for locking the roof in the closed configuration, wherein the lock is operable from inside the roof to selectively lock and unlock the roof to respectively prevent and allow movements thereof from the closed configuration to the open configuration.

2. The shelter as defined in claim 1, wherein, in the closed configuration, the roof, supporting component, first end wall and second end wall together delimit an enclosure for sheltering the human in the sleeping position on the main supporting surface.

3. The shelter as defined in claim 1, wherein in the open configuration, the roof is located below the main supporting surface.

4. The shelter as defined in claim 1, wherein the supporting component is attached to both the first and second end walls so that when the first and second end walls are supported on a ground surface, the supporting component is supported in a spaced apart relationship relative to the ground surface by the first and second end walls.

5. The shelter as defined in claim 1, wherein the roof includes at least one protective panel of generally arcuate configuration mounted to first and second guides of arcuate configuration provided at the first and second end walls so that the at least one protective panel is movable along the first and second guides, the at least one panel being movable between closed and open panel positions, wherein in the closed panel position, the roof is in the closed configuration and the at least one protective panel is in an at least partially overlying relationship relative to at least a portion of the supporting component, and in the open panel position, the roof is in the open configuration and the at least one protective panel is at least partially retracted from the at least a portion of the supporting component.

6. The shelter as defined in claim 5, wherein the first and second guides each include at least one arcuate groove spanning a larger angle than the at least one panel and to which the at least one protective panel is mounted so as to be movable therealong.

7. The shelter as defined in claim 5, wherein the at least one protective panel includes first and second protective panels each of generally arcuate configuration, the second protective panel having a second panel radius of curvature smaller than a first panel radius of curvature of the first protective panel.

8. The shelter as defined in claim 7, wherein the first and second arcuate guides each include a pair of grooves, the grooves within each of the pair of grooves having different groove radii of curvature, the first and second protective panels being each mounted to a respective one of the grooves from the pair of grooves in both the first and second guides so that the first and second protective panels are movable along the grooves.

9. The shelter as defined in claim 7, wherein the first protective panel includes a first coupler and the second protective panel includes a second coupler, the first and second couplers being configured and sized to mechanically interfere with each other when the at least two panels are in a predetermined positional relationship relative to each other to allow dragging the second protective panel along the first and second guides by the first protective panel when the first protective panel is moved along the first and second guides by an intended user.

10. The shelter as defined in claim 9, wherein in the predetermined configuration the first and second protective panels are substantially in register with each other.

11. The shelter as defined in claim 10, wherein in the open configuration, the first and second protective panels are in the predetermined configuration.

12. The shelter as defined in claim 9, wherein in the predetermined configuration, the first and second protective panels are offset from each other so that only a portion thereof overlap.

13. The shelter as defined in claim 12, wherein in the closed configuration, the first and second protective panels are in the predetermined configuration.

14. The shelter as defined in claim 9, further comprising a seal between the first and second couplers.

15. The shelter as defined in claim 7, wherein the first and second protective panels each span between about 85 and 95 degrees.

16. The shelter as defined in claim 7, wherein the first and second guides each define a deployed section and a stowage section, the first and second protective panels being in the deployed section in the closed configuration and the first and second protective panels being in the stowage section in the open configuration.

17. The shelter as defined in claim 16, wherein in the open configuration, the first and second protective panels are substantially in register with each other in a stowage section.

18. The shelter as defined in claim 16, wherein the stowage section is located below the supporting component.

19. The shelter as defined in claim 5, wherein the roof is substantially hemicylindrical.

20. The shelter as defined in claim 1, wherein the shelter further defines an enclosed storage space below the supporting component, the enclosed storage space being accessible through a selectively openable door.

21. The shelter as defined in claim 20, wherein the door extends between the first and second end walls and is mounted thereto.

22. The shelter as defined in claim 1, wherein the lock is also operable from outside the roof.

23. The shelter as defined in claim 1, wherein the supporting component includes supporting component first and second sections hinged to each other and movable between a bed configuration in which the supporting component first and second sections are substantially co-planar, and a bench configuration wherein the supporting component first section is substantially horizontal and the supporting component second section extends away from the supporting component first section at an upward angle relative thereto.

24. The shelter as defined in claim 1, further comprising a cushioning component supported by the supporting component.

25. The shelter as defined in claim 1, further comprising a mosquito screen movable between mosquito screen deployed and retracted configurations, wherein, in the mosquito screen deployed configuration, the mosquito screen, supporting component, first end wall and second end wall form an enclosure from which mosquitoes are substantially prevented from entering, and in the mosquito screen retracted configuration, the mosquito screen is at least in part retracted from the supporting component to allow access to the main supporting surface.

26. A shelter comprising:

a supporting component having a main supporting surface configured and sized for supporting a human in a sleeping position, the supporting component defining substantially opposed supporting component first and second longitudinal ends;

a first end wall and a second end wall provided respectively at the supporting component first and second longitudinal ends; and a roof movable between a closed configuration and an open configuration, wherein, in the closed configuration, the roof is overlying the main supporting surface, and in the open configuration, the roof is at least partially retracted from the main supporting surface to allow outside access thereto;

wherein the roof includes at least one protective panel of generally arcuate configuration mounted to first and second guides of arcuate configuration provided at the first and second end walls so that the at least one protective panel is movable along the first and second guides, the at least one panel being movable between closed and open panel positions, wherein in the closed panel position, the roof is in the closed configuration and the at least one protective panel is in an at least partially overlying relationship relative to at least a portion of the supporting component, and in the open panel position, the roof is in the open configuration and the at least one protective panel is at least partially retracted from the at least a portion of the supporting component;

further wherein the at least one protective panel includes first and second panels each of generally arcuate configuration, the second panel having a second panel radius of curvature smaller than a first panel radius of curvature of the first protective panel.

27. The shelter as defined in claim 26, wherein the first protective panel includes a first coupler and the second protective panel includes a second coupler, the first and second couplers being configured and sized to mechanically interfere with each other when the at least two panels are in a predetermined positional relationship relative to each other to allow dragging the second protective panel along the first and second guides by the first protective panel when the first protective panel is moved along the first and second guides by an intended user.

28. The shelter as defined in claim 27, wherein in the predetermined configuration, the first and second protective panels are offset from each other so that only a portion thereof overlap.

29. The shelter as defined in claim 27, further comprising a seal between the first and second couplers.

30. The shelter as defined in claim 26, wherein the first and second protective panels each span between about 85 and 95 degrees.

* * * * *